US006746171B2

(12) United States Patent
Welch

(10) Patent No.: US 6,746,171 B2
(45) Date of Patent: Jun. 8, 2004

(54) MODULAR RING BINDER ASSEMBLY WITH REMOVABLE RIVETS

(75) Inventor: Stephen R. Welch, Roselle, IL (US)

(73) Assignee: Compton Presentation Systems, Roselle, IL (US)

( * ) Notice: Subject to any disclaimer, the term of this patent is extended or adjusted under 35 U.S.C. 154(b) by 200 days.

(21) Appl. No.: 09/769,723

(22) Filed: Jan. 25, 2001

(65) Prior Publication Data

US 2002/0098030 A1 Jul. 25, 2002

(51) Int. Cl.[7] ..... B42F 3/04

(52) U.S. Cl. ..... 402/36; 402/31; 402/26; 402/38; 402/70; 402/73

(58) Field of Search ..... 281/36, 37; 402/36–42, 402/31, 26, 70, 73, 79, 80 L

(56) References Cited

U.S. PATENT DOCUMENTS 4,722,627 A * 2/1988 Salacuse ..... 402/36
5,879,097 A * 3/1999 Cheng ..... 402/36
5,964,544 A * 10/1999 Ko ..... 402/36
6,209,917 B1 * 4/2001 Welch ..... 281/36

* cited by examiner

*Primary Examiner*—Willmon Fridie, Jr.

(57) ABSTRACT

In accordance with the present invention, there is provided a ring binder assembly that includes a cover, a ring mechanism and a means to removably secure the cover to the ring mechanism. The removable securing means includes a pair of removable rivets. The removable rivets may in a first embodiment include a pair of resilient tail members that can be pinched together in order to pass through openings in the cover and the ring mechanism. The resilient tail members tend to have a diameter larger then the openings such that when the resilient tail members pass through the openings, the resilient tail members return to their larger diameter configuration. This permits a consumer or user with the ability to disassemble the components of the ring binder assembly and interchange these components with new components similarly configured. The user may then customize and personalize the ring binder assembly to their own specifications.

17 Claims, 8 Drawing Sheets

MODULAR RING BINDER ASSEMBLY WITH REMOVABLE RIVETS

FIELD OF THE INVENTION

This invention relates to ring binders, and more particularly to a ring binder assembly that includes removable rivets, which permits the ring mechanism to be removable from the cover.

BACKGROUND OF THE INVENTION

A typical ring binder assembly includes a ring mechanism attached to a binder case (such as a front, spine and back cover) by a rivet or other securing means well known in the art (hereinafter referred to as "a ring binder assembly"). In today's market, binders are shipped and bought by the consumer already assembled. The consumer purchasing the binders has relatively little selection in the design, function, style, color, or size of the binders. When purchasing, the consumer must choose the color or design of the cover and the size of the rings. These features remain fixed and a consumer desiring to change any one of the features must buy a new binder. As such, a need remains to provide a ring binder assembly that permits a user to change the cover, ring capacity and the overall design or color of the binder without having to purchase an entirely new binder. Such a need would further provide the consumer not only with the ability to change any component or components of the ring binder assembly but also with the ability to initially choose and assemble the components. Rather then being discarded when the specific functionality runs out, a modular binder assembly may be changed, adapted or updated to the specific needs of the individual. As such the binder may be recycled rather than discarded, saving landfill space in the process.

SUMMARY OF THE INVENTION

In accordance with the present invention, there is provided a ring binder assembly that includes a cover, a ring mechanism and a means to removably secure the cover to the ring mechanism. The removable securing means may be defined as a pair of removable rivets. The removable rivets may in a first embodiment include a single piece rivet with a pair of resilient tail members. The resilient tail members tend to have a diameter larger then the openings in the cover and the ring mechanism but may be pinched together in order to pass through such openings, such as used when the ring mechanism has an eyelet inside of it. Once through the openings, the resilient tail members tend to return to their larger diameter configuration. This permits a consumer or user with the ability to disassemble the components of the ring binder assembly and interchange these components with new components similarly configured. The user may then customize and personalize the ring binder assembly to their own specifications.

In a second embodiment, the removable rivet may include a two-piece configuration. The two-piece configuration would include male and female pieces that are frictionally held together when assembled. To separate the two pieces a force may be applied against either one of the pieces opposite to the other piece, as used when the ring mechanism has a pinched end without eyelets.

Moreover, in use with the removable securing means, a cover may be provided with a plurality of pairs of openings and/or a plurality of knuckles. Each pair of openings and corresponding knuckles is adapted to receive a ring mechanism with a predetermined ring size. As such the user may purchase a first ring mechanism and then later replace the first ring mechanism with a second ring mechanism with a larger or smaller ring size, depending upon the specific needs of the consumer. The cover would then bend about the knuckles around the ring mechanism forming a singular one-piece uncompromised cover. Moreover, depending upon how the cover was bent about the ring mechanism the cover may form various designs and shapes.

BRIEF DESCRIPTION OF THE DRAWINGS

A fuller understanding of the foregoing may be had by reference to the accompanying drawings, wherein.

DETAILED DESCRIPTION OF THE DRAWINGS

Figure 1A:
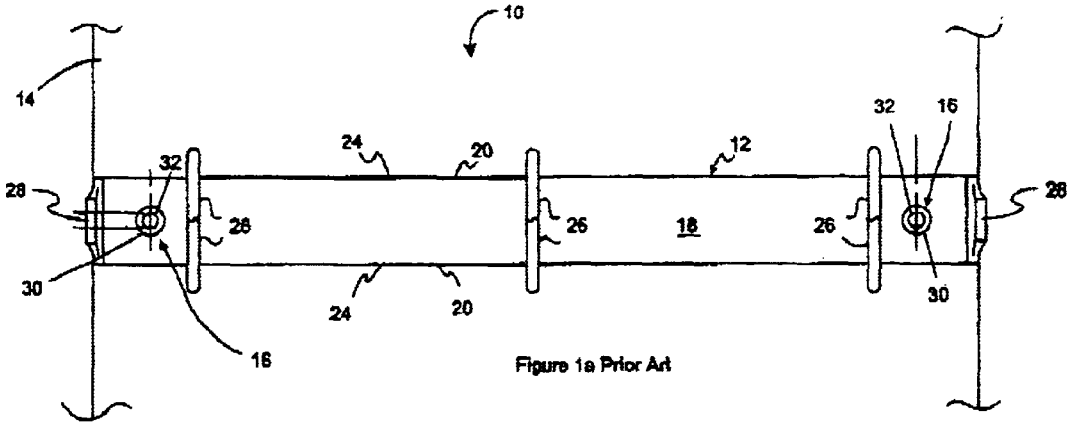
Figure 1a Prior Art
FIG. 1*a* is a top view of a ring mechanism assembly in accordance with the prior art.
Figure 1B:
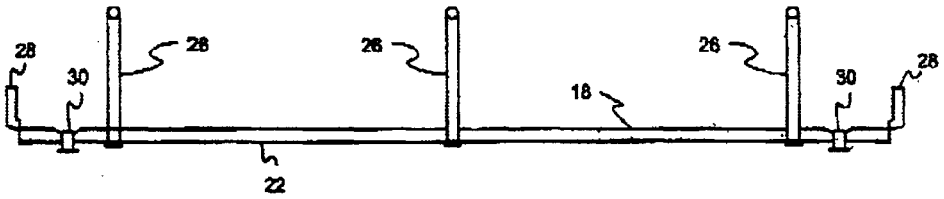
Figure 1b Prior Art
FIG. 1*b* is a side view of the ring mechanism assembly from FIG. 1*a;*
Figure 1C:
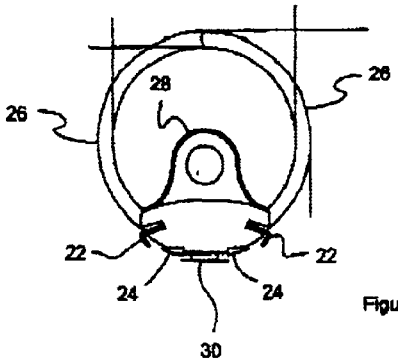
Figure 1c Prior Art
FIG. 1*c* is a rear view of the ring mechanism assembly from FIG. 1*a;*

While the invention is susceptible to embodiments in many different forms, there are shown in the drawings and will be described herein, in detail, the preferred embodiments of the present invention. It should be understood, however, that the present disclosure is to be considered an exemplification of the principles of the invention and is not intended to limit the spirit or scope of the invention and/or claims of the embodiments illustrated.

Referring to FIGS. 1*a*–1*d*, a conventional ring binder assembly generally designated as 10 typically comprises a ring mechanism 12 connected to a cover 14 by a securing means 16. Typically, the ring mechanism 12 includes a convex upper plate 18 having lateral edges 20 that are bent inward to form longitudinal seats 22, which further support a pair of pivotable lower plates 24. Three rings 26, each formed in two halves are typically mounted into the pivotable lower plates 24. The ring mechanism 12 also includes a pair of actuating levers 28 that are attached to the ends of the ring mechanism 12, in a manner well known in the art, such that when the actuating levers 28 are pivoted outwardly, the lower plates 24 pivot such that the ring halves 26 open. The ring mechanism 12 also includes a pair of eyelets 30 secured there through at each end, separately. Each eyelet 30 receives the securing means or a rivet 32, which also passes through the cover 14, thereby securing the cover 14 to the ring mechanism 12, forming the ring binder assembly 10. Illustrated in prior art FIG. 1*d*, the rivets 32 are usually made of metal and are riveted in place by equipment that curls the end portion 34 of the tail 36 around the eyelet 30.

It should be noted, that various other conventional ring mechanisms, such as those that incorporate more or less rings, ring mechanisms without actuating levers or boosters or without eyelets, may be employed herein without deviating from the spirit or scope of the invention.

When the ring binder assembly 10 is completed, the architecture of the ring binder assembly 10 may not be changed because the components are permanently secured to each other. For instance: the number of pairs of rings, the size or shape of the rings, as well as the color, design and shape of the cover 14, the ring mechanism 12 and the rivets 32 may not be changed once assembled. However, as mentioned above, it would be extremely desirous for consumers to be able to change or personalize their own ring binder assembly. Currently this is only possible by purchasing a new ring binder assembly.

A modular ring binder assembly in accordance with the present invention includes a ring mechanism and a cover, which may be as described above, and a means to removably secure the ring mechanism to the cover. The removable securing means may be presented in various shapes and forms but it ultimately permits a user to securely attach a ring mechanism to a cover and then at a later time remove the ring mechanism from the cover and reattach either of them to a second ring mechanism or a second cover respectively. Moreover, the removable securing means permits the interchangeability between components (ring mechanisms and covers) well known in the art, such that new manufacturing of these components is not required to utilize the present invention. Instead of the consumer purchasing a single fully assembled ring binder assembly, the consumer would have the option at any time to change, modify or update the ring binder assembly. With the ability to change ring mechanisms, covers and possibly even the design or color of the removable securing means, the user will be able to personalize the ring binder assemblies to fit their own needs.

Figure 2:
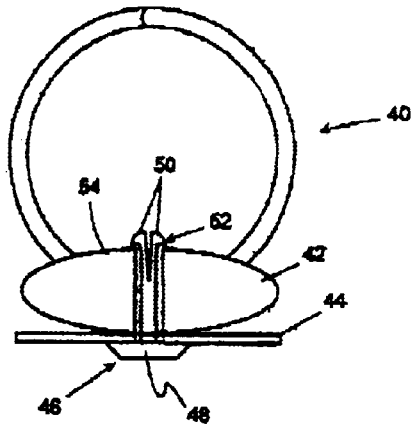
FIG. 2 is a sectional view of a modular ring mechanism assembly illustrating a removable rivet in accordance with the present invention.

Referring now to FIG. 2, a modular ring binder assembly 40 in accordance with the present invention includes a ring mechanism 42, a cover 44 and a means to removably secure the ring mechanism 42 to the cover 44. In one embodiment of the present invention, the removable securing means 46 is positioned through an opening in the cover 44 and an opening or eyelet in the ring mechanism 42 securing them together. As illustrated in FIG. 2 the removable securing means 46 may be a removable rivet 48 with a pair of resilient members 50 on the tail 52. In its normal configuration, the removable rivet 48 has a tail 52 with a diameter larger then the diameter of the eyelet 54 in the ring mechanism and larger then the diameter of the opening in the cover 44. However, when the resilient members 50 are pinched, the tail 52 has a diameter smaller then the eyelet 54 and cover opening, such that tail 52 may pass through the eyelet 54 and an opening (not shown) in the cover 44. Once passed through the opening in the cover 44 and the eyelet 54, the resilient members 50 return to the normal configuration and the removable rivet 48 is secured in place and more importantly securing the ring mechanism and cover together. As mentioned above if the ring mechanism incorporates a pair of openings instead of eyelets 54, the removable rivet 48 would be received in these openings as described above, removably securing a cover to the ring mechanism. To remove the removable rivets 48, the user can pinch the resilient members 50 together and push or slide the removable rivets 48 back through the opening and/or eyelet.

Figure 3:
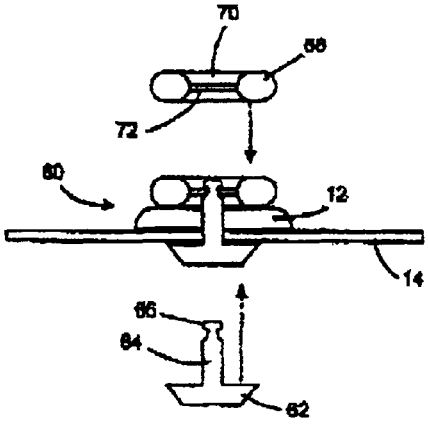
FIG. 3 is a sectional view illustrating a two-piece removable rivet in accordance with a second embodiment of the present invention.

Referring now to FIG. 3, in another embodiment of the present invention the removable securing means may be a two-piece rivet 60. As illustrated, the invention may be used with no boosters or actuating levers. The two-piece rivet 60 includes a male and female piece 62 and 68 respectively. The male piece 62 has a member 64, which extends outwardly therefrom and is sized to be received within a bore 70 defined in the female piece 68. The female piece 68 includes a lip portion 72 within the bore 70 that frictionally engages the end 66 of the member 64. When assembled, the male piece 62 is inserted through the cover 14 and the ring mechanism 12. The female piece 68 may then frictionally engage the male piece 62 and removably secure the male piece 62 thereto. To separate the male and female pieces 62 and 68, the user may apply a pressure in between the female piece 68 and the ring mechanism 12 and pry the female piece 68 upwardly until the lip portion 72 disengages the end 66 of the male portion 68.

Figure 4:
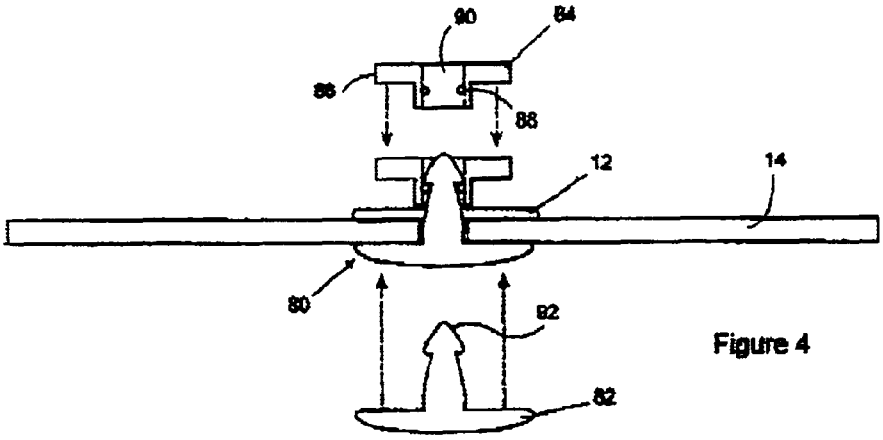
FIG. 4 is a sectional view of another two-piece removable rivet in accordance with yet another embodiment of the present invention.

Referring now to FIG. 4, in another embodiment of the present invention, a two-piece rivet 80 is shown. Similarly described above, a male piece 82 is inserted through the cover and ring mechanism and attached to a female piece 84. However, the female piece 84 includes a base 86 that leads to a narrow member 88, which extends downwardly from the base 86. The narrow member 88 includes a bore 90 that receives the extending member 92 of the male piece 82. To separate the piece, a person may apply a pressure against the base 86 away from the cover 14 or ring mechanism 12.

The various embodiments illustrate a removable securing means that preferably includes two removable rivets, one positioned at each end of the modular ring binder assembly, however, the removable securing means is not necessarily limited in that regard. It is contemplated by the present invention to increase or decrease the number of removable rivets. Moreover, the removable rivets may be integrally molded to the cover, thereby preventing the possibility that a removable rivet is lost or misplaced.

Figure 1D:
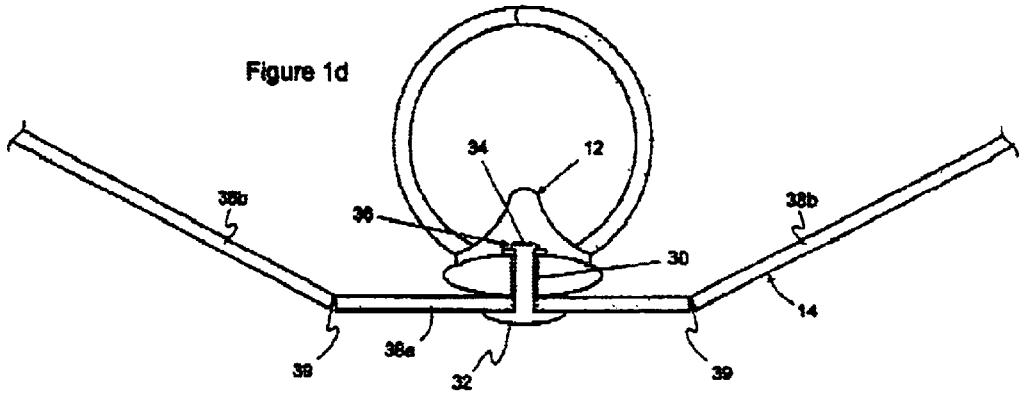
FIG. 1*d* is a sectional view of the ring mechanism assembly from FIG. 1*a* illustrating the rivet in accordance with the prior art.
Figure 5A:
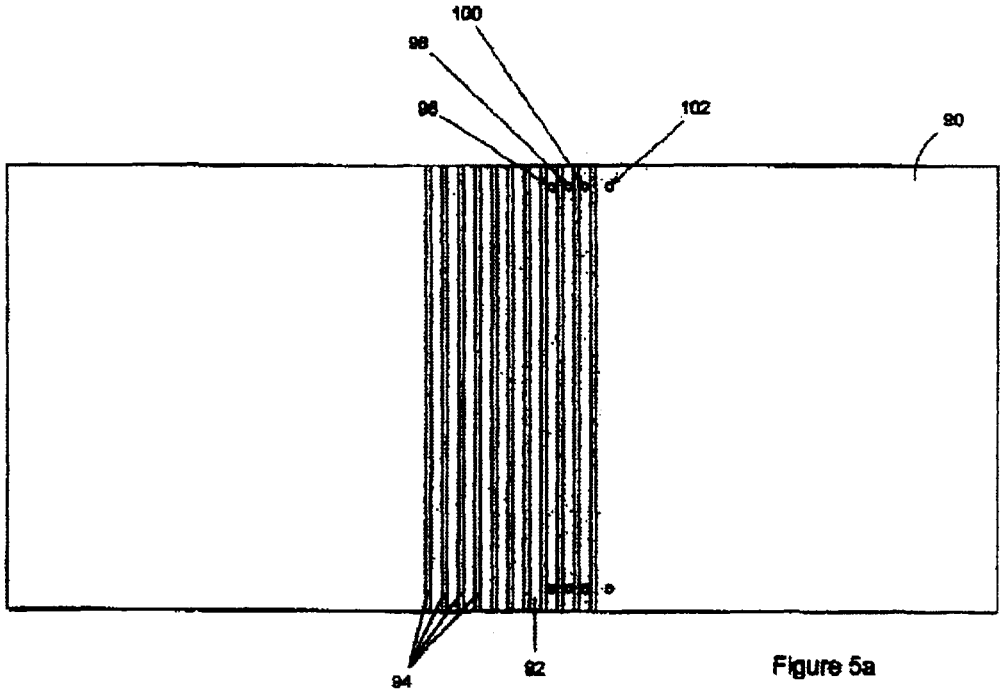
FIG. 5*a* is a top view of a cover defined with a plurality of pairs of openings and corresponding knuckles such that the cover is designed to receive different sized ring mechanisms.

Since the present invention permits a user to interchange various sizes of ring mechanisms, for instance to remove a 1" ring capacity ring mechanism and replace it with a 2" ring capacity ring mechanism or alternatively a ½" ring capacity ring mechanism, it would further be desirous to have a cover that would accommodate for such a change. Referring now to FIG. 5*a*, a cover 90 is illustrated that would permit a user to increase or decrease the ring capacity of the ring mechanism without having to purchase a larger or smaller cover. As illustrated in FIG. 1*d* a conventional cover 14 includes a spine 38*a* and two sides 38*b*. If the cover 14 is made from a single board then perforated edges 39 are punched into the board to form the sides 38*b*. The perforated edges 39 further permit the cover to open and close bending about the perforated edges 39. More importantly, when the cover 14 is manufactured, the perforated edges 39 are spaced apart to define the spine and sides that will specifically accommodate a single ring capacity. While the cover may be capable of receiving a smaller ring capacity comfortably, the ability to receive a larger ring capacity may not permit the cover to close properly.

Figure 5B:
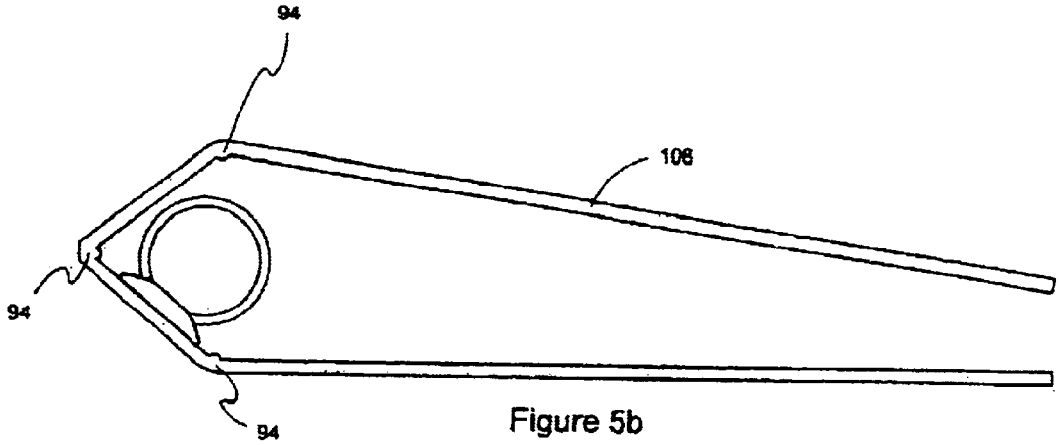
FIG. 5*b* is a side view of the cover illustrated in FIG. 5*a* while receiving a ring mechanism and bent about three knuckles to define a diamond-backed modular ring binder assembly.
Figure 5C:
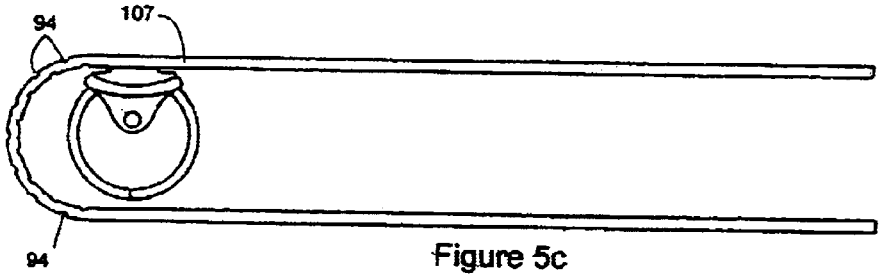
FIG. 5*c* is a side view of the cover illustrated in FIG. 5*a* while receiving a ring mechanism and bent about plurality of knuckles to define circular-backed modular ring binder assembly.
Figure 5D:
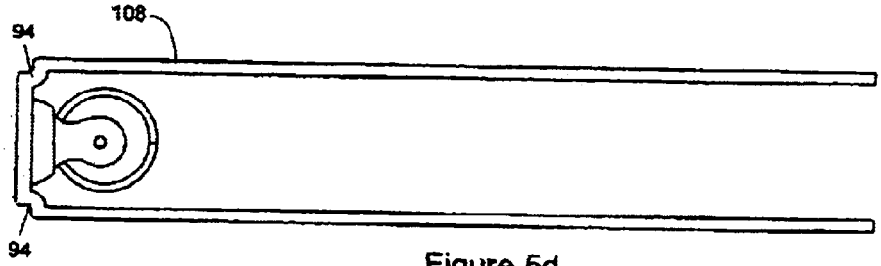
FIG. 5*d* is a side view of the cover illustrated in FIG. 5*a* while receiving a ring mechanism and bent about two knuckles to define a flat-backed modular ring binder assembly.

As illustrate in FIG. 5*a* the cover 90 includes a plurality of knuckles 94 spaced transversely at predefined positions. Each knuckle 94 runs vertically across the cover, such that the cover may bend about any one of the knuckles 94. If for instance the cover 90 was bent about two knuckles 94 sufficiently spaced apart, the cover 90 would define a spine, positioned between the bent knuckles, and two sides, positioned on either side of the bent knuckles, which would be similarly configured to the cover 14 illustrated in FIG. 1*d*. Relative to the knuckles 94, the cover 90 also includes a plurality of pairs of openings 92 spaced transversely along the knuckles 94 and on opposite ends of the cover 90, to further accommodate for varying sizes of ring capacities. For instance, the first pair of openings 96 correspond to a ¾" ring capacity on a ring mechanism, the second pair of openings 98 corresponds to a 1" ring capacity ring mechanism, the third pair of openings 100 corresponds to a 1½" ring capacity ring mechanism, and the fourth pair of openings 102 corresponds to a 2" ring capacity ring mechanism. As mentioned above, a consumer purchasing the cover 90 along with the removable securing means has the ability to increase or decrease the ring capacity without having to purchase a larger or smaller cover. Moreover, the cover 90 may further bend about two or more knuckles to produce: a diamond-back cover 106 illustrated in FIG. 5*b*; a substantially round or circular-back cover 107 illustrated in FIG. 5*c*; a flat-back cover illustrated in FIG. 5*d*; or etc.

Figure 6A:
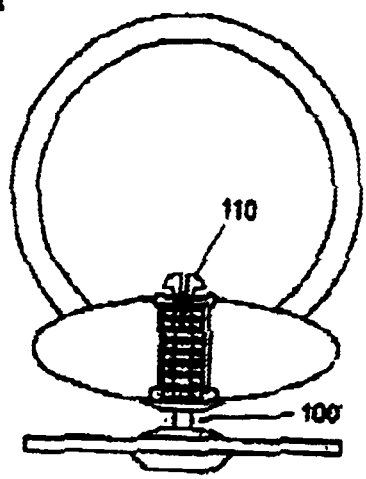
FIG. 6*a* is a side view of a modular ring binder assembly with a removable rivet incorporated in a ring mechanism with a telescoping eyelet.
Figure 6B:
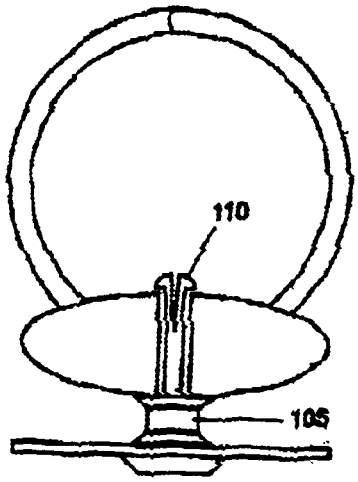
FIG. 6*b* is a side view of a modular ring binder assembly with a removable rivet incorporated in a ring mechanism with a spool-shaped washer.

The present invention may also be used in connection with various types of eyelets. For instance, the removable securing means may be used with a single eyelet/washer piece or with a separate two-piece eyelet/washer. Illustrated in FIGS. 6*a* and 6*b*, a telescoping eyelet 100, one piece eyelet/washer (not shown) or spool-shaped washer 105 may be used with the removable rivets 110 such that modules would be able to attach to the modular ring binder assembly in between the ring mechanism and the cover (illustrated in FIGS. 6*a* and 6*b*). As referred to herein, modules permit a consumer to hold, attach or secure various office, home, school, and recreational supplies to the module themselves. For example, one module may have a pocket for holding pencils or pens, while another module may be designed to secure floppy disks, CD-ROMs, or cellular phones. The ability to remove or change modules further permits the consumer with the ability to completely personalize a ring binder assembly. In accordance therewith, the consumer would then be able to also choose various removable modules to attach to the modular ring binder assembly.

Figure 7A:
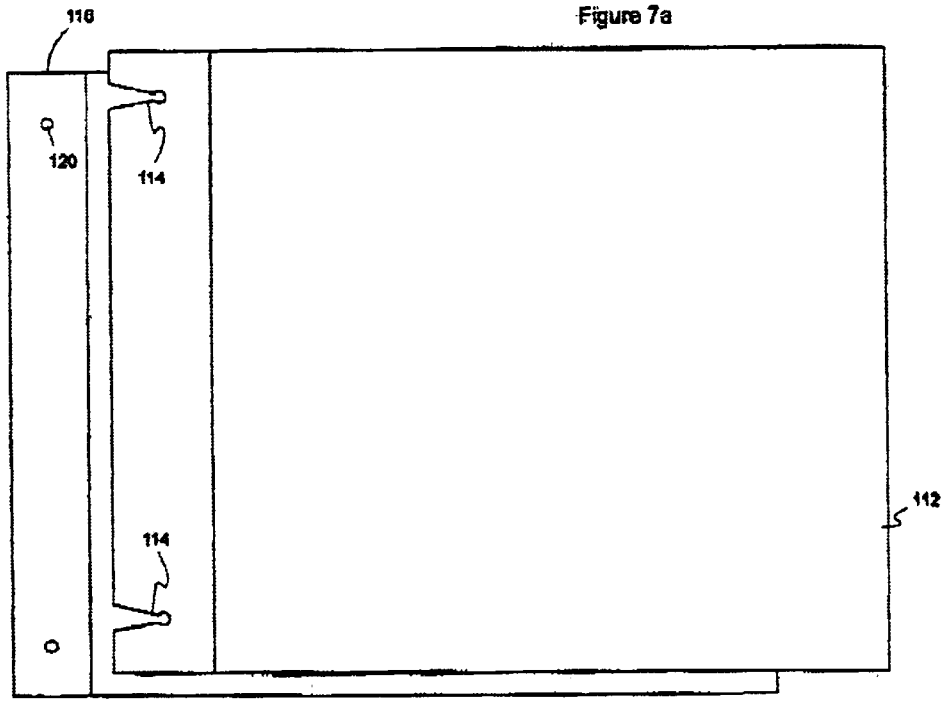
FIG. 7*a* is a top view of two modules utilizing different means for connecting to a ring binder assembly.
Figure 7B:
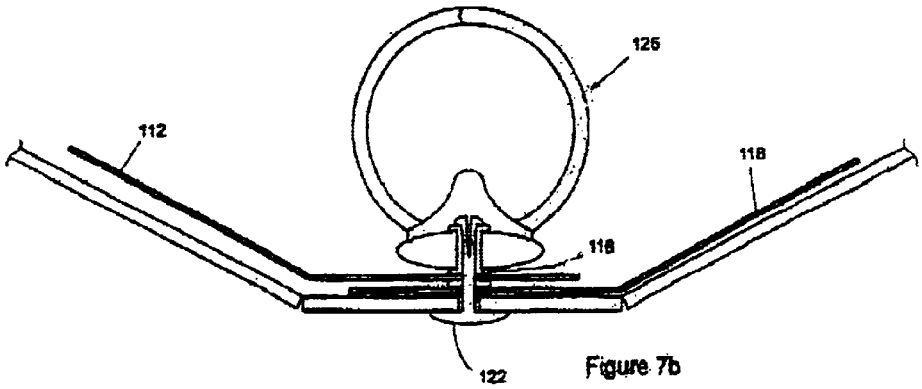
FIG. 7*b* is a side view of a modular ring binder assembly with a removable rivet incorporating a ring mechanism with a unitary eyelet/washer piece and receiving the two modules illustrated in FIG. 7*a*.

Referring now to FIG. 7*a*, the present invention further permits the modules to be attached to the removable securing means themselves. As shown, a module 112 may include notches 114 such that the module 112 may removably attach to the eyelet/washer 116 (illustrated in FIG. 7*b*). However, a second module 118 may also include openings 120 that are sized to receive the removable rivet 122 themselves. The second module 118 may then be more securely attached to the modular ring binder assembly 125. A consumer desiring to change the second module 118 may simply remove the removable rivet 122 and replace the second module 118 with a third module (not shown) similarly configured.

While manufacturers assemble various ring binder assemblies by including different designs and colors for the cover and various ring capacity sizes, the manufactures cannot assemble an unlimited variety of colors, designs and sizes. However, by producing the components (the ring mechanism, the cover and the removable securing means) separately the consumer would be capable of personalizing the final assembled ring binder assembly. By selecting the color and design of each component the consumer will be able to assemble their own desired ring binder assembly, and moreover, will be capable of changing the color or design of any one of the components without having to repurchase an entire assembly. Moreover, the module ring binder assembly in accordance with the present invention has the ability to increase ring capacity and accept a wide variety of modules.

In another embodiment of the present invention, the entire modular ring binder assembly may be made from non-metal material, such as but not limited to plastic. While manufactures today do provide for non-metal ring mechanisms, the rivets or securing means are metal. By using a non-metal removable rivet the entire assembly may be non-metal. The environmental advantages for having an entirely non-metallic assembly allow manufactures to make biodegradable ring binder assemblies. Also, students walking through metal detectors or travelers would not have to be concerned with the metal detectors going off, if the ring binder assembly was entirely made of non-metal materials.

From the foregoing and as mentioned above, it will be observed that numerous variations and modifications may be effected without departing from the spirit and scope of the novel concept of the invention. It is to be understood that no limitation with respect to the specific methods and apparatus illustrated herein is intended or should be inferred. It is, of course, intended to cover by the appended claims all such modifications as fall within the scope of the claims.

We claim:

1. A modular ring binder assembly comprising a ring mechanism, a cover having openings and including a plurality of knuckles spaced transversely across said cover, each knuckle permitting the cover to bend about said knuckle; and a plurality of pairs of openings spaced transversely along the knuckles, each pair of openings being positioned to accommodate a ring mechanism with a predetermined ring capacity, each pair of openings further corresponding to the openings in a ring mechanism, some of which are in alignment with the openings in said cover, at least two removable rivets received in corresponding openings in the ring mechanism and in the cover securing said ring mechanism to said cover, wherein when a first ring mechanism having a ring capacity is removably secured to the cover, the cover may bend about a first set of knuckles to form a spine and two sides accommodating said first ring mechanism, and upon said first ring mechanism being replaced with a second ring mechanism having a different ring capacity than said first ring mechanism, the cover may further bend about a second set of knuckles of said plurality of knuckles forming a spine and two sides accommodating said second ring mechanism, wherein when the removable rivets are removed, the ring mechanism, the cover and the removable rivets may be interchangeable with a second ring mechanism and a second cover and additional removable rivets.

2. The modular ring binder assembly of claim 1 further comprising:

a module having openings corresponding to the openings in the ring mechanism and in the cover, such that when the removable rivets are aligned with and secured in the openings in the module, in the ring mechanism and in the cover, the module may be removably secured to the modular ring binder assembly.

3. The modular ring binder assembly of claim 1 further comprising:

a module having slots corresponding to the openings in the ring mechanism and in the cover, such that when the ring mechanism is removably secured to the cover by the removable rivets, the slots of said module may engage the removable rivets such that said module is removable attached to the modular ring binder assembly.

4. The modular ring binder assembly of claim 1 wherein each removable rivet has a tail portion and a pair of resilient members extending from the tail portion, the pair of resilient members has a normal configuration defined as having a diameter larger then the openings in the cover and the ring mechanism, the resilient members may also be pinched such that the pair of resilient members may pass through the openings in the cover and the ring mechanism wherein after the resilient members pass through the openings in the cover and the ring mechanism, the resilient members tend to return to the normal configuration.

5. The modular ring binder assembly of claim 4 wherein each removable rivet includes a male/female configuration.

6. The modular ring binder assembly of claim 1 wherein the cover, ring mechanism and removable rivets are made of a non-metal material.

7. The modular ring binder assembly of claim 1 wherein each removable rivet includes a male/female configuration.

8. The modular ring binder assembly of claim 7 wherein the modular ring binder assembly is made entirely of non-metal materials.

9. A modular ring binder assembly comprising a ring mechanism; a cover, at least one removable rivet received in corresponding openings in the ring mechanism and in the cover securing said ring mechanism to said cover, each removable rivet having a tail portion, the pair of resilient members extending from the tail portion, the pair of resilient members has a normal configuration defined as having a diameter larger than the openings in the cover and the ring mechanism, the resilient member may further be pinched such that the pair of resilient members may pass through the openings in the cover and the ring mechanism wherein after the resilient members pass through the openings in the cover and the ring mechanism, the resilient members tend to return to the normal configuration wherein the cover secures said ring mechanism to said cover.

10. The modular ring binder assembly of claim 9 wherein the cover further comprises:

a plurality of knuckles spaced transversely across said cover, each knuckle permitting the cover to bend about said knuckle; and a plurality of pairs of openings spaced transversely along the knuckles, each pair of openings being positioned to accommodate a ring mechanism with a predetermined ring capacity, each pair of openings further corresponding to openings in a ring mechanism such that the removable rivets may pass through the pair of openings in the cover and in the ring mechanism, wherein when a first ring mechanism having a ring capacity is removably secured to the cover, the cover may bend about a first set of knuckles, of said plurality of knuckles, to form a spine and two sides accommodating said first ring mechanism, and upon said first ring mechanism being replaced with a second ring mechanism having a different ring capacity than said first ring mechanism, the cover may further bend about a second set of knuckles, of said plurality of knuckles, forming a spine and two sides accommodating said second ring mechanism.

11. The modular ring binder assembly of claim 10 further comprising:

at least one module removably attached to the modular ring binder assembly between the ring mechanism and the cover.

12. The modular ring binder assembly of claim 11 wherein the modular ring binder assembly is made entirely of non-metal materials.

13. A modular ring binder assembly;

a ring mechanism having a pair of openings oppositely opposed;

a cover having openings corresponding to the openings in the ring mechanism;

a pair of removable rivets received in the openings in the ring mechanism and the corresponding openings in the cover removably securing said ring mechanism to said cover and means to removably attach at least one module between the ring mechanism and the cover including a pair of spool-shaped washers, each spool-shaped washer having an opening and being aligned with one of the openings in the ring mechanism, the aligned openings further being sized to receive one of the removable rivets; and a pair of slots defined on the module and corresponding to the spool-shaped washer, such that the slots may frictionally engage the pair of spool-shaped washers separately.

14. The modular ring binder assembly of claim 13 wherein the ring mechanism further includes a pair of eyelets, each eyelet being sized to engage the openings in the ring mechanism and integrally formed to one of the spool-shaped washers.

15. The modular ring binder assembly of claim 14 wherein each removable rivet has a tail portion and a pair of resilient members extending from the tail portion, the pair of resilient members has a normal configuration defined as having a diameter larger then the eyelets and the openings in the cover, the resilient members may also be pinched such that the pair of resilient members may pass through the openings in the cover and the eyelets wherein after the resilient members pass through the openings in the cover and the eyelets, the resilient members tend to return to the normal configuration.

16. The modular ring binder assembly of claim 15 wherein the cover includes:

a plurality of knuckles spaced transversely across said cover, each knuckle permitting the cover to bend about said knuckle; and a plurality of pairs of openings spaced transversely along the knuckles, each pair of openings being positioned to accommodate a ring mechanism with a predetermined ring capacity, each pair of openings further corresponding with the eyelets in a ring mechanism such that the pair of removable rivets may pass through a pair of openings in the cover and the eyelets in the ring mechanism;

wherein when a first ring mechanism having a ring capacity is removably secured to the cover, the cover may bend about a first set of knuckles, of said plurality of knuckles, to form a spine and two sides accommodating said first ring mechanism, and upon said first ring mechanism being replaced with a second ring mechanism having a different ring capacity than said first ring mechanism, the cover may further bend about a second set of knuckles, of said plurality of knuckles, forming a spine and two sides accommodating said second ring.

17. The modular ring binder assembly of claim 16 wherein the modular ring binder assembly is made of a non-metal material.

* * * * *